US007419233B2

(12) United States Patent
Katayama

(10) Patent No.: US 7,419,233 B2
(45) Date of Patent: Sep. 2, 2008

(54) INK-JET RECORDING APPARATUS AND INK CARTRIDGE SET

(75) Inventor: Naoki Katayama, Kariya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 552 days.

(21) Appl. No.: 10/948,207

(22) Filed: Sep. 24, 2004

(65) Prior Publication Data

US 2005/0068390 A1 Mar. 31, 2005

(30) Foreign Application Priority Data

Sep. 30, 2003 (JP) ..... 2003-341965

(51) Int. Cl.
*B41J 2/195* (2006.01)
*B41J 2/175* (2006.01)

(52) U.S. Cl. ..... 347/7; 347/86

(58) Field of Classification Search ..... 347/7, 347/86, 19, 84

See application file for complete search history.

(56) References Cited

U.S. PATENT DOCUMENTS 5,757,390 A 5/1998 Gragg et al.
6,234,597 B1 * 5/2001 Suzuki et al. ..... 347/7
6,557,991 B2 * 5/2003 Koitabashi et al. ..... 347/101

FOREIGN PATENT DOCUMENTS

| | | | |
|---|---|---|---|
| EP | 0 443 245 | A2 * | 8/1991 |
| GB | 2 245 973 | A * | 1/1992 |
| JP | A-57-034989 | | 2/1982 |
| JP | 60220824 | A * | 11/1985 |
| JP | A-09-001819 | | 1/1997 |

* cited by examiner

*Primary Examiner*—Stephen D Meier
*Assistant Examiner*—Geoffrey Mruk
(74) *Attorney, Agent, or Firm*—Oliff & Berridge, PLC

(57) ABSTRACT

Ink cartridges 1*a* to 1*c* for storing light-transmissive inks include a shutter arranged therein so that the shutter is movable depending on the ink residual amount, and a projection 51 having light transmittance and passing the shutter therethrough. An ink cartridge 1*d* for storing a nontransparent ink includes a projection 51 having light transmittance. Optical sensors 21*a* to 21*c*, which detect the shutter at the projection 51 of the ink cartridges 1*a* to 1*c* respectively, are arranged at a position higher in the vertical direction than a position of arrangement of an optical sensor 21*d* detecting the ink at the projection 51 of the ink cartridge 1*d*. It is possible to use both an ink cartridge for storing a light-transmissive ink and an ink cartridge for storing a nontransparent ink, and the ink amount is correctly detected for any one of the cartridges.

19 Claims, 4 Drawing Sheets

INK-JET RECORDING APPARATUS AND INK CARTRIDGE SET

BACKGROUND OF THE INVENTION

1. Field of the Invention

The present invention relates to an ink-jet recording apparatus for performing the printing by discharging inks to a recording objective medium, and an ink cartridge set to be used therefor.

2. Description of the Related Art

An ink-jet printer is known, which performs the printing by discharging an ink from nozzles of an ink-jet head to recording paper. In general, such an ink-jet printer is provided with a detachable ink cartridge for supplying the ink to the ink-jet head. When the ink-jet head is driven to perform the discharge operation in a state in which the ink is empty in the ink cartridge, then the printing is not only performed, but the air sometimes makes invasion from the ink cartridge into the ink-jet head. The ink-jet head, into which the air has made invasion, cannot be used in some cases. Therefore, it is necessary to detect the amount of the ink stored in the ink cartridge. A method for detecting the amount of the ink is conceived, in which the amount of the ink is detected by estimating and accumulating the amounts of the ink used every time when the printing is performed. However, any error tends to arise in such calculation. Therefore, it is necessary to stop the use of the ink cartridge with a sufficient margin. As a result, the ink is wasted. Accordingly, the following technique has been suggested (see, for example, Japanese Patent Application Laid-open No. 9-001819, FIG. 7). That is, a float, which has a specific gravity smaller than that of the ink, is arranged on the ink stored in the ink cartridge. The height of the float floating on the ink is detected from the outside by using an optical sensor to detect the amount of the ink contained in the ink cartridge thereby.

A dye ink, which has light transmittance or transparency, is generally employed for the ink to be used for the ink-jet printer. However, a problem has arisen such that the contour tends to be fuzzed especially when letters are printed, because the ink is blurred on the recording paper. Therefore, it is demanded that the black ink, which is frequently used in the recording of letters, is a pigment ink which has the nontransparency in order to perform the printing of higher quality. However, when it is intended to detect the ink amount by the technique as described above for the ink cartridge which uses the pigment ink, the following problem arises because both of the ink and the float have the nontransparency. That is, it is impossible to detect only the float with the optical sensor, and it is impossible to detect the correct ink amount. Accordingly, it is conceived that the ink itself is detected directly by using the optical sensor for only the ink cartridge which uses the ink having the nontransparency. A light-transmissive type sensor, in which the cost is relatively cheap, is generally used as the optical sensor to be employed for the detection. However, when the detection is performed more accurately, or when a sensor, which is relatively unsatisfactory in accuracy, is used in order to further decrease the cost, it is conceived that the thickness of a portion for accommodating the ink as a detection objective is partially thinned in order to shorten the distance between a light-emitting section and a light-receiving section of the sensor. However, as for the ink disposed at the portion which is partially thinned, the ink is adhered to the wall surface by the surface tension, and the ink liquid surface is raised. Therefore, a problem arises such that a liquid surface, which is higher than the actual ink liquid surface, is detected, and it is impossible to correctly detect the predetermined ink amount.

SUMMARY OF THE INVENTION

Accordingly, a principal object of the present invention is to provide an ink-jet recording apparatus in which an ink cartridge for storing a light-transmissive ink and an ink cartridge for storing a nontransparent ink can be used together, and the ink amount can be correctly detected for any one of the ink cartridges, and an ink cartridge set to be used for the same.

According to a first aspect of the present invention, there is provided an ink cartridge set for an ink-jet recording apparatus, comprising:

a first ink cartridge (1*a*) which includes a first ink tank (11) for storing a light-transmissive ink, and a nontransparent member (34) arranged in the first ink tank so that the nontransparent member (34) is movable depending on a residual amount of the ink, the first ink tank (11) having a first light-transmissive area across which the nontransparent member (34) passes; and a second ink cartridge (1*d*) which includes a second ink tank (11) for storing a nontransparent ink which is formed with a second light-transmissive area, and which includes no nontransparent member (34).

According to the ink cartridge set including the plurality of ink cartridges of the present invention, the light-transmissive ink and the nontransparent ink can be used together in a mixed manner. In particular, presence of the light-transmissive ink can be detected with blocking of light transmission by the nontransparent member which is provided in the first ink tank and which is movable depending on the ink level, and presence of the nontransparent ink can be detected with blocking of light transmission by the ink. Therefore, in the ink cartridge set, it is possible to simplify the structure of the ink cartridge for accommodating the nontransparent ink, and it is possible to reduce the production cost and avoid the waste consumption of resources. Further, in the ink cartridge set of the present invention, the light-transmissive ink may be a dye ink, and the nontransparent ink may be a pigment ink.

According to a second aspect of the present invention, there is provided an ink-jet recording apparatus (101) comprising an ink-jet head (5) which discharges inks; a first holder (70*a*) which holds a first ink cartridge (1*a*) which includes a first ink tank (11) for storing a light-transmissive ink, and a nontransparent member (34) arranged in the first ink tank (11) so that the nontransparent member (34) is movable depending on a residual amount of the ink, the first ink tank (11) having a first light-transmissive area across which the nontransparent member (34) passes; a second holder (70*d*) which holds a second ink cartridge (1*d*) which includes a second ink tank (11) for storing a nontransparent ink, the second ink tank (11) being formed with a second light-transmissive area; a first optical sensor (21*a*) which includes a first light-emitting section (ee) and a first light-receiving section (rr) arranged opposed to each other to interpose the first light-transmissive area of the first ink cartridge (1*d*) held by the first holder (70*a*); and a second optical sensor (21*d*) which includes a second light-emitting section and a second light-receiving section arranged opposed to each other to interpose the second light-transmissive area of the second ink cartridge (1*d*) held by the second holder (70*d*), the second light-emitting section and the second light-receiving section being arranged at positions higher than those of the first light-emitting section and the first light-receiving section of the first optical sensor (21*a*) in a direction of change of a liquid surface of the ink.

According to the ink-jet recording apparatus of the present invention, the second optical sensor is arranged at the position higher than that of the first optical sensor. This is based on the fact that the presence (residual amount) of the ink is detected with the nontransparent member in the first ink tank, while the presence (residual amount) of the ink is detected irrelevant to the nontransparent member in the second ink tank. For example, the presence of the ink residual amount can be detected by detecting blocking of light transmission by the ink, because the remaining ink functions as the nontransparent member in the second ink tank. It is possible to correctly detect both of the amount of the ink detected for the first ink cartridge which stores the light-transmissive ink and the amount of the ink detected for the second ink cartridge which stores the nontransparent ink.

In the ink-jet recording apparatus of the present invention, the first and second light-transmissive areas may be provided at first and second projections (51) which protrude from side surfaces of the first and second ink tanks (11) respectively; the first and second projections (51) may have internal spaces (51*a*) thereof which are communicated with internal spaces of the first and second ink tanks (11) respectively; and the first and second projections (51) may have widths which are smaller than widths of the side surfaces of the first and second ink tanks (11) respectively. Further, the width of the projection (51) may be not more than 3 mm. Accordingly, it is possible to use a cheap light-transmissive type optical sensor in which the light-receiving section and the light-emitting section are disposed closely to one another.

In the ink-jet recording apparatus of the present invention, both of the first and second projections (51) may be formed at least over areas of sizes which are obtained by combining sizes of the first and second light-transmissive areas in the direction of change of the liquid surface of the ink. Accordingly, the projection serves as the light-transmissive area, and thus the amount of the stored ink can be detected by using the optical sensor.

In the ink-jet recording apparatus of the present invention, the first and second projections (51) may be formed to have an identical dimension. Further, the first and second ink cartridges (1*a*, 1*d*) may have an identical dimension. Accordingly, it is possible to use common parts for the first and second ink cartridges. It is possible to decrease the production cost of the ink cartridge.

In the ink-jet recording apparatus of the present invention, the first ink cartridge (1*a*) may comprise a swinging member (32) which is swingable with respect to a support point provided in the first ink tank (11), the swinging member (32) may include the nontransparent member (34) which is provided at one end and a float (33) which is provided at the other end and which has a specific gravity smaller than that of the light-transmissive ink, and the nontransparent member (34) may be arranged in the internal space (51*a*) of the first projection (51). Accordingly, the orbit of the float is fixed by the swinging member. Therefore, it is possible to avoid the adhesion of the float to the side surface of the ink tank due to any disturbance such as the surface tension of the ink.

In the ink-jet recording apparatus of the present invention, a rotational force, which is received by the swinging member (32) by buoyancies and gravities generated on the nontransparent member (34) and the float (33) respectively when the nontransparent member (34) and the float (33) are positioned in an ink liquid, may be in a first direction that is opposite to a second direction of a rotational force received by the swinging member (32) by buoyancies and gravities generated on the nontransparent member (34) and the float (33) respectively when at least parts of the nontransparent member (34) and the float (33) protrude from an ink liquid surface; and the nontransparent member (34) may be positioned in the first light-transmissive area when the swinging member (32) receives the rotational force in the first direction, while the nontransparent member (34) may be positioned at a position deviated from the first light-transmissive area when the swinging member (32) receives the rotational force in the second direction. Accordingly, it is possible to detect, with the first optical sensor, the situation in which the light-transmissive ink does not remain in the first ink tank and the situation in which the ink cartridge with the stored light-transmissive ink is not installed to the holder.

In the ink-jet recording apparatus of the present invention, the first and second ink cartridges (1*a*, 1*d*) may be detachable with respect to the first and second holders (70*a*, 70*d*) respectively. Accordingly, the ink can be replenished by the simple operation in which the first and second ink cartridges are exchanged.

The ink-jet recording apparatus of the present invention may further comprise a judging unit (62) which judges states of residual amounts of the inks in the first and second ink cartridges (1*a*, 1*d*) depending on results of detection obtained by the first and second optical sensors (21*a*, 21*d*); wherein the judging unit (62) judges a state in which a sufficient amount of the ink is charged in the first ink cartridge (1*a*) installed to the first holder (70*a*) when the first optical sensor (21*a*) detects the nontransparent member (34), while the judging unit (62) judges any one of a state in which the ink is decreased in the first ink cartridge (1*a*) installed to the first holder (70*a*) and a state in which the first ink cartridge (1*a*) is not installed to the first holder (70*a*) when the first optical sensor (21*a*) does not detect the nontransparent member (34); and the judging unit (62) judges a state in which a sufficient amount of the ink is charged in the second ink cartridge (1*d*) installed to the second holder (70*d*) when the second optical sensor (21*d*) detects the ink adhered to an inner wall of the second projection (51), while the judging unit (62) judges any one of a state in which the ink is decreased in the second ink cartridge (1*d*) installed to the second holder (70*d*) and a state in which the second ink cartridge (1*d*) is not installed to the second holder (70*d*) when the second optical sensor (21*d*) does not detect the ink adhered to the inner wall in the second projection (51). Accordingly, the judging unit may use the first and second optical sensors to judge not only the amounts of the inks in the first and second ink cartridges, respectively, but also whether or not the first and second ink cartridges are installed to the first and second holders, respectively.

In the ink-jet recording apparatus of the present invention, the light-transmissive ink may be a dye ink, and the nontransparent ink may be a pigment ink. Accordingly, it is possible to use the dye ink and the pigment ink together in a mixed manner.

DESCRIPTION OF THE PREFERRED EMBODIMENTS

A preferred embodiment according to the present invention will be explained below with reference to the drawings.

Figure 1:
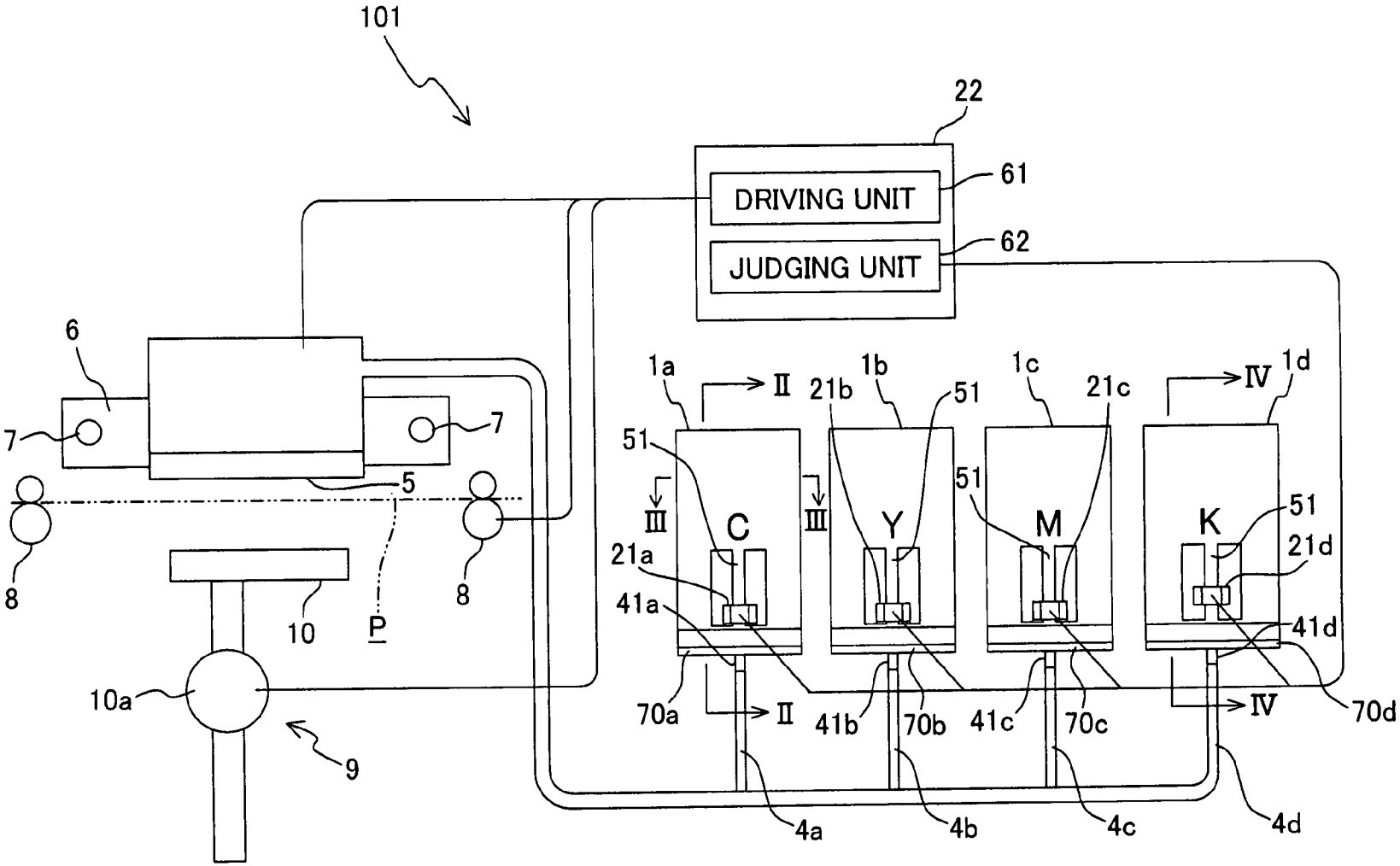
FIG. 1 shows a schematic view illustrating an ink-jet printer including ink cartridges according to an embodiment of the present invention.

FIG. 1 shows a partial schematic view illustrating an ink-jet printer (ink-jet recording apparatus) according to the preferred embodiment of the present invention.

As shown in FIG. 1, the ink-jet printer 101 includes an ink-jet head 5 which discharges four types of inks of cyan (C), yellow (Y), magenta (M), and black (K) to recording paper P, ink cartridges 1*a* to 1*d* which store the respective inks to be discharged to the ink-jet head 5, a carriage 6 which moves the ink-jet head 5 linearly reciprocatively in a certain direction (direction perpendicular to the sheet surface of the drawing) along the guide 7, a transport mechanism 8 which transports the recording paper P in a direction perpendicular to the direction of movement of the ink-jet head 5 in parallel to the ink discharge surface of the ink-jet head 5, a purge unit 9 which sucks the high viscosity ink and the air contained in the ink-jet head 5, optical sensors 21*a* to 21*d* which respectively detect the ink amounts in the ink cartridges 1*a* to 1*d* and the presence or absence of the installation of the ink cartridges 1*a* to 1*d*, and a control unit 22 which controls the components as described above.

The ink-jet head 5 has the ink discharge surface on which a large number of nozzles for discharging the ink are formed. The ink-jet head 5 discharges, from the nozzles, the respective inks supplied from ink supply tubes 4*a* to 4*d* by being controlled by the control unit 22. One end of each of the ink supply tubes 4*a* to 4*d* is connected to the ink-jet head 5, and the other end is connected to each of ink supply pipes 41*a* to 41*d*.

The ink cartridges 1*a* to 1*d* are detachably installed to holders 70*a* to 70*d*. A projection 51, which is convex toward the outside (outgoing direction from the sheet surface of the drawing), is formed at a central portion of a side surface of each of the ink cartridges 1*a* to 1*d*. The projection 51 extends in the vertical direction, and its width is 3 mm. The projection 51 has an internal space 51*a* which is communicated with the ink tank as described later on (see FIG. 3). The respective inks of cyan, yellow, and magenta, which are stored in the ink cartridges 1*a* to 1*c*, are dye inks, and they have light transmittance or transparency. The black ink, which is stored in the ink cartridge 1*d*, is a pigment ink, and it has nontransparency. A light-transmissive area, which has transparency, is formed at the projection 51.

The purge unit 9 is arranged at the outside of the recording paper P on the driving orbit of the ink-jet head 5. The purge unit 9 includes a purge cap 10 which is movable in the direction to make approach/separation with respect to the ink discharge surface of the ink-jet head 5 and which is to be installed to the ink discharge surface of the ink-jet head 5, and a suction pump 10*a* which sucks the ink. The driving operation of the suction pump 10*a* is controlled by the control unit 22.

Each of the optical sensors 21*a* to 21*d* is a light-transmissive type optical sensor, which outputs the detection result to the control unit 22. The optical sensor 21*a* to 21*d* is U-shaped. A light-emitting section and a light-receiving section, which are opposed to each other, are provided at respective ends of the optical sensors. The detection result output is turned ON/OFF depending on whether or not the light emitted from the light-emitting section is received by the light-receiving section. The optical sensors 21*a* to 21*d* are arranged so that the respective projections 51 of the ink cartridges 1*a* to 1*d* are interposed between the light-emitting sections and the light-receiving sections (see FIG. 3). The detecting position, which is the position of arrangement of the optical sensor 21*d* in the cartridge 1*d*, is higher in the vertical direction than the detecting positions which are the positions of arrangement of the optical sensors 21*a* to 21*c* in the cartridges 1*a* to 1*c*.

The control unit 22 includes CPU (Central Processing Unit) which serves as a computing processing unit, ROM (Read Only Memory) in which programs to be executed by CPU and data to be used for the programs are stored, and RAM (Random Access Memory) which temporarily stores data during the execution of the program. These components function as respective functional sections in an integrated manner, and thus the ink-jet printer 1 is controlled. The control unit 22 is provided with functional sections of a driving unit 61 and a judging unit 62. The driving unit 61 is provided to control the driving of the respective units including, for example, the ink-jet head 5, the carriage 6, and the motor for driving the transport mechanism 8 as well as the suction pump 10*a* of the purge unit 9. The judging unit 62 judges the presence or absence of the ink cartridges 1*a* to 1*d* and the amounts of the stored inks depending on the detection results inputted from the optical sensors 21*a* to 21*d*.

In the ink-jet printer 101, the respective inks stored in the ink cartridges 1*a* to 1*d* are supplied to the ink-jet head 5 through the supply tubes 4*a* to 4*d*. The ink-jet head 5 is driven reciprocatively by the carriage 6. The respective inks are discharged from the nozzles to the recording paper P transported by the transport mechanism 8, and thus a desired image is formed on the recording paper P. The ink-jet head 5 is moved onto the purge cap 10 of the purge unit 9 by the carriage 6 every time when the printing is completed. After that, the purge cap 10 is moved to make contact with the ink discharge surface of the ink-jet head 5. The suction pump 10*a* is driven in this state, and the air and the high viscosity inks are sucked from the nozzles of the ink-jet head 5.

Figure 2B:
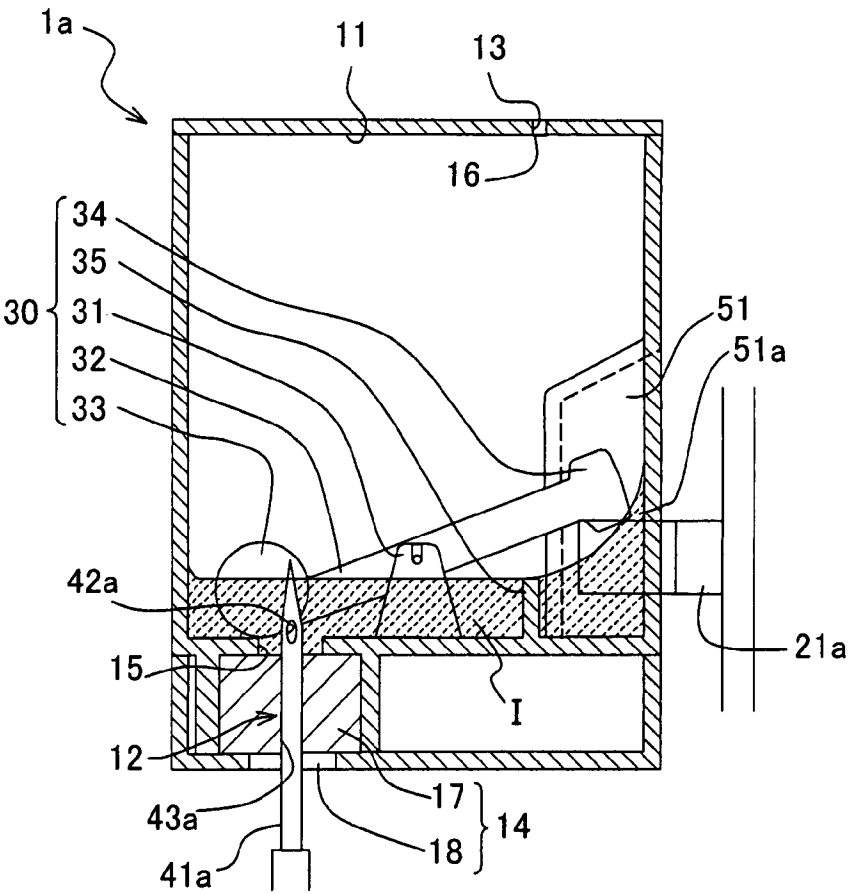
FIGS. 2A and 2B show sectional views taken along a line II-II shown in FIG. 1 illustrating the ink cartridge depicted in FIG. 1.
Figure 2A:
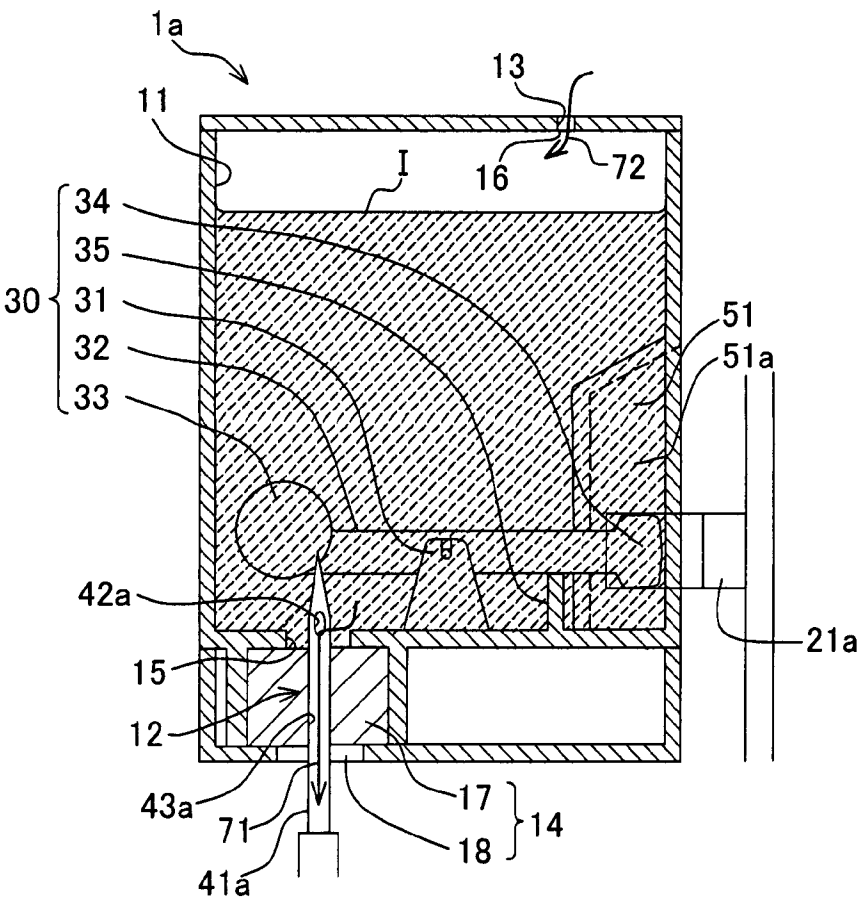
Figure 3:
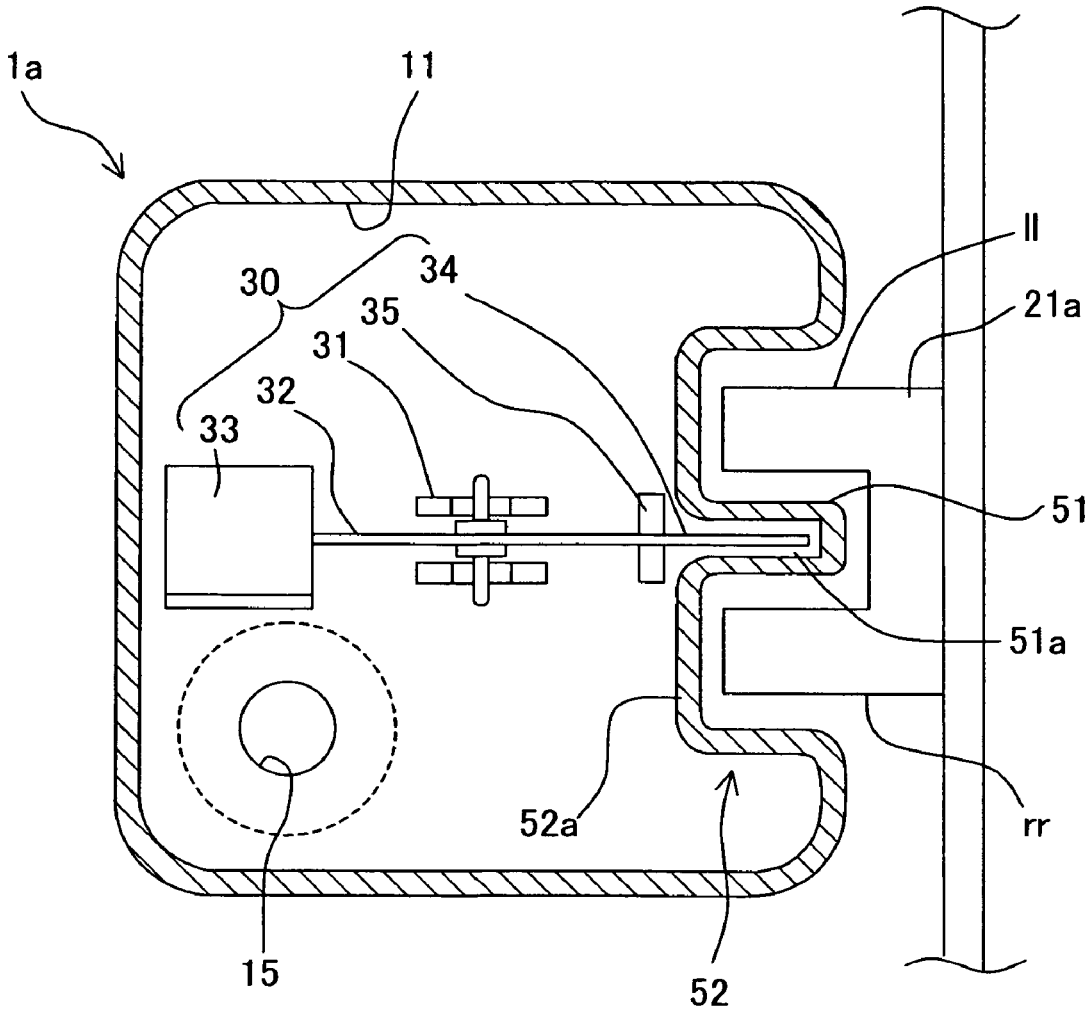
FIG. 3 shows a sectional view taken along a line III-III shown in FIG. 1 illustrating the ink cartridge depicted in FIG. 1.

Next, an explanation will be made with reference to FIGS. 2 and 3 about details of the ink cartridges 1*a* to 1*c* (first ink cartridge set) and the optical sensors 21*a* to 21*c*. The ink cartridges 1*a* to 1*c* are different from each other only in the type of the stored ink, for which all of the other arrangements are the same. Any explanation about the ink cartridge 1*a* is applicable to the ink cartridges 1*b* and 1*c*. Therefore, only the ink cartridge 1*a* will be explained in detail, and any detailed explanation about the ink cartridges 1*b* and 1*c* will be omitted. FIG. 2 shows sectional views taken along a line II-II shown in FIG. 1 illustrating the ink cartridge 1*a*. FIG. 2A shows a sectional view illustrating a situation in which a sufficient amount of the ink is stored in the ink cartridge 1*a*. FIG. 2B shows a sectional view illustrating a situation in which any sufficient amount of the ink is not stored in the ink cartridge 1*a*. In the drawing, an arrow 71 indicates the flow of the ink, and an arrow 72 indicates the flow of the atmospheric air. FIG. 3 shows a sectional view taken along a line III-III shown in FIG. 1 illustrating the ink cartridge 1*a*.

As shown in FIG. 2A, the ink cartridge 1*a* is a substantially rectangular parallelepiped-shaped case formed of a light-transmissive synthetic resin. The ink cartridge 1*a* includes an ink tank which stores the light-transmissive ink of the cyan dye (I in the drawing, yellow dye ink in the ink cartridge 1*b* and magenta dye ink in the ink cartridge 1*c*), an ink outflow passage 12 which is provided penetratingly through a packing 17 as described later on for allowing the ink stored in the ink tank to flow to the outside of the ink cartridge 1*a*, an atmospheric air inflow passage 13 which allows the atmospheric air to flow into the ink tank 11, a joint 14 which connects the ink tank and the ink supply pipe 41*a* and which holds the ink supply pipe 41*a* in the ink outflow passage 12, and a shutter mechanism 30. The ink supply pipe 41*a* is a tube or pipe having a tapered shape to be connected to the ink cartridge 1*a*. The ink supply pipe 41*a* is provided with a plurality of ink inflow ports 42*a* which are formed so that the ink inflow ports 42 are disposed in the circumferential direction of the sealed tip, and an intra-tubular ink flow passage 43*a* which is communicated with the outside through the ink inflow ports 42*a*.

The ink tank is a space comparted by the inner wall of the ink cartridge 1*a*. The ink tank is provided with an ink outflow port 15 which allows the stored ink to flow to the ink outflow passage 12, and an atmospheric air inflow port 16 which allows the atmospheric air to flow (see the arrow 72) as the ink flows from the ink outflow port 15. The ink outflow port 15 is provided through the bottom surface of the ink tank 11. The atmospheric air inflow port 16 is provided through the top surface of the ink tank 11. That is, the ink tank is communicated with the ink outflow passage 12 through the ink outflow port 15, and the ink tank 11 is communicated with the atmospheric air inflow passage 13 through the atmospheric air inflow port 16. As shown in FIG. 3, a projection 52, which protrudes toward the inside of the ink tank 11, is provided on one inner side wall of the ink tank 11. A projection 51 is formed, which protrudes from the bottom wall 52*a* of the projection 52 toward the outside of the ink tank and which extends in the vertical direction over a range from the bottom surface to a position in the vicinity of the center. The internal space 51*a* of the projection 51 is communicated with the interior of the ink tank 11, in which the ink may exist.

The ink outflow passage 12 is arranged at the under portion of the ink tank 11. The ink inflow passage 12 is communicated with the ink tank through the ink outflow port 15. The atmospheric air inflow passage 13 is arranged at the upper portion of the ink tank 11. The atmospheric air inflow passage 13 is communicated with the ink tank via the atmospheric air inflow port 16, and the atmospheric air inflow passage 13 is communicated with the atmospheric air on the side opposite to the atmospheric air inflow port 16. When the ink cartridge 1*a* is in an unused state, the side opposite to the atmospheric air inflow port 16 is sealed so that the atmospheric air does not inflow into the atmospheric air inflow passage 13.

The joint 14 connects the ink tank and the ink supply pipe 41*a*. The joint 14 is provided with a packing 17 which is arranged in a space comparted by the inner wall of the ink cartridge 1*a*, and an insertion hole 18 which is formed at the under portion of the packing 17. The packing 17 is formed of an elastic member composed of a flexible resin. The ink outflow passage 12 is formed in the packing 17. When the ink supply pipe 41*a* is not inserted into the packing 17, the ink outflow passage 12 is sealed by the elastic force of the packing 17. The insertion hole 18 is a circular hole which is formed through the bottom surface of the ink cartridge 1*a*. The ink supply pipe 41*a* is inserted into the insertion hole 18 when the ink tank is connected to the ink supply pipe 41*a*.

When the ink tank and the ink supply pipe 41*a* are connected to each other, the ink supply pipe 41*a* is inserted into the insertion hole 18 of the joint 14. When the ink supply pipe 41*a* is further pressed in a state in which the tip of the ink supply pipe 41*a* inserted into the insertion hole 18 arrives at the packing 17, then the packing 17 is pierced by the ink supply pipe 41*a* with the tip having the tapering needle shape, and the ink supply pipe 41*a* penetrates through the ink outflow passage 12 formed in the packing 17. When the ink supply pipe 41*a*, which has penetrated through the packing 17, is further pressed, then the tip of the ink supply pipe 41*a* penetrates through the ink outflow port to arrive at the ink tank 11, and the connection is completed. In this situation, the ink inflow port 42*a* of the ink supply pipe 41*a* is arranged in the ink tank 11. Accordingly, the flow is formed (arrow 71), in which the ink stored in the ink tank inflows through the ink inflow port 42*a* into the intra-tubular ink flow passage 43*a* arranged in the ink supply pipe 41*a*.

The shutter mechanism 30 is driven on the basis of the amount of the ink stored in the ink tank 11. The shutter mechanism 30 is arranged at the bottom of the ink tank 11. The shutter mechanism 30 includes a support stand 31, a lever (swinging member) 32, a float 33 which is arranged at one end of the lever 32, a shutter (nontransparent member) 34 which is arranged at the other end of the lever 32, and a regulating member 35.

The support stand 31 is a trapezoidal member fixed to a portion in the vicinity of the center of the bottom of the ink tank 11. The lever 32 is a thin plate-shaped member extending in a certain direction. The lever 32 is supported by the support stand 31 so that the extending direction is arranged perpendicularly to the bottom wall 52*a* of the projection 52 of the ink tank and the lever 32 is swingable about the pivot point of the center in the extending direction.

The float 33 is a member composed of a polyacetal resin having a cylindrical shape arranged at the end of the lever 32 on the side opposite to the side wall on which the projection 51 of the ink tank is formed. The float 33 has an enormous volume as compared with the shutter 34. A closed space, which is filled with the air, is formed in the float 33. The specific gravity of the entire float 33 is smaller than the specific gravity of the ink. Therefore, when the ink amount is large in the ink tank 11, and the entire float 33 is positioned in the ink, then the buoyancy generated on the float 33 is large, and the rotational force, which is brought about when the float 33 is rotated in the direction (hereinafter referred to as "first direction") to make upward movement, is generated on the lever 32. On the other hand, when the ink amount is small, and at least a part of the float 33 protrudes from the ink liquid surface as shown in FIG. 2B, then the buoyancy generated on the float 33 is small, and the rotational force, which is in the direction (hereinafter referred to as "second direction") to make downward movement of the float 33, is generated on the lever 32.

The shutter 34 is a nontransparent and substantially rectangular area formed at the end of the lever 32 opposite to the side on which the float 33 is arranged. The shutter 34 is arranged so that the shutter 34 passes across the internal space 51*a* of the projection 51 formed on the side wall of the ink tank when the lever 32 makes the swinging movement. Specifically, as shown in FIG. 2A, when the ink amount is large in the ink tank 11, and the entire float 33 is positioned in the ink, then the float 33 is moved upwardly, and the lever 32 is rotated in the clockwise direction (first direction). Accordingly, the shutter 34 is arranged at the detecting position in the vicinity of the bottom of the projection 51 on the side of the ink tank 11. As shown in FIG. 2B, when the ink amount is small, and a part of the float 33 protrudes from the ink liquid surface, then the float 33 is moved downwardly, and the lever 32 is rotated in the counterclockwise direction (second direction). Accordingly, the shutter 34 is arranged at the non-detecting position in the vicinity of the top of the projection 51 on the side of the ink tank 11. The weight and the volume of the shutter 34 are sufficiently smaller than the weight and the volume of the float 33. The gravity and the buoyancy, which are generated on the shutter 34, are sufficiently smaller than those generated on the float 33. In other words, the rotational forces in the first and second directions, which are generated on the lever 32, are determined by the gravity and the buoyancy generated on the float 33 and the gravity and the buoyancy generated on the shutter 34. However, the rotational forces in the first and second directions are substantially determined by the gravity and the buoyancy generated on the float 33.

As shown in FIG. 2A, the regulating member 35 regulates the swinging movement of the lever 32 so that the shutter 34 is arranged at the detecting position when the ink amount is large in the ink tank 11, and the entire float 33 is positioned in the ink liquid. The regulating member 35 is plate-shaped, and it is arranged on the bottom of the ink tank 11. Specifically, the rotation is regulated by allowing the end of the regulating member 35 to make contact with the lever 32 so that the shutter 34 is arranged at the detecting position when the ink amount is large, and the entire float 33 is positioned in the ink liquid.

As shown in FIG. 3, the optical sensor 21*a* is arranged so that a part of the projection (first light-transmissive area) 51, which is formed on the side wall of the ink tank 11, is interposed between the light-emitting section and the light-receiving section from the outside of the ink tank 11. The optical sensor 21*a* detects whether or not the light transmittance is blocked by the shutter 34 of the shutter mechanism 30, and the optical sensor 21*a* outputs an obtained result of detection. In other words, the optical sensor 21*a* outputs, to the judging unit of the control unit 22, the detection result of ON when the shutter 34 of the shutter mechanism 30 is arranged at the detecting position at which the optical sensor 21*a* is arranged in the vicinity of the bottom of the projection 51, or OFF when the shutter 34 of the shutter mechanism 30 is not arranged at the detecting position.

Next, an explanation will be made about the operation of the shutter mechanism 30 and the optical sensor 21*a*. As shown in FIG. 2A, when the ink amount is large in the ink tank 11, the entire shutter mechanism 30 is arranged in the stored ink liquid. In this situation, the lever 32 receives the rotational force in the first direction by the combined force of the gravity and the buoyancy generated on the float 33 and the gravity and the buoyancy generated on the shutter 34. However, when the lever 32 makes contact with the end of the regulating member 35, the rotation in the first direction is regulated. In this state, the shutter 34 is arranged at the detecting position. When the shutter 34 is arranged at the detecting position, the optical sensor 21*a* outputs ON to the judging unit 62. The judging unit 62, into which ON has been inputted from the optical sensor 21*a*, judges that the ink cartridge 1*a* is installed to the holder 70*a*, and a sufficient amount of the ink is stored in the ink tank 11.

On the other hand, as shown in FIG. 2B, when the ink amount in the ink tank is decreased as the ink is consumed, the float 33 and the shutter 34 gradually appear on the ink liquid surface. Accordingly, the buoyancy in the clockwise direction, which is generated on the float 33, is greatly decreased as compared with the buoyancy in the counterclockwise direction generated on the shutter 34, because the volume of the float 33 is sufficiently larger than that of the shutter 34 as described above. As a result, when the ink is consumed to arrive at a certain amount, then the combined force described above serves as the rotational force directed in the second direction, and the lever 32 is rotated in the second direction. Accordingly, the lever 32 is separated from the end of the regulating member 35, and the shutter 34 is arranged at the non-detecting position. When the residual amount of the ink is approximately zero, then the buoyancy generated from the float 33 is zero, and the rotational force in the second direction is large. When the shutter 34 is arranged at the non-detecting position, the optical sensor 21*a* outputs OFF to the judging unit 62. The judging unit 62, into which OFF has been inputted from the optical sensor 21*a*, judges that the ink cartridge 1*a* is not installed to the holder 70*a*, or any sufficient amount of the ink is not stored in the ink tank 11.

Figure 4B:
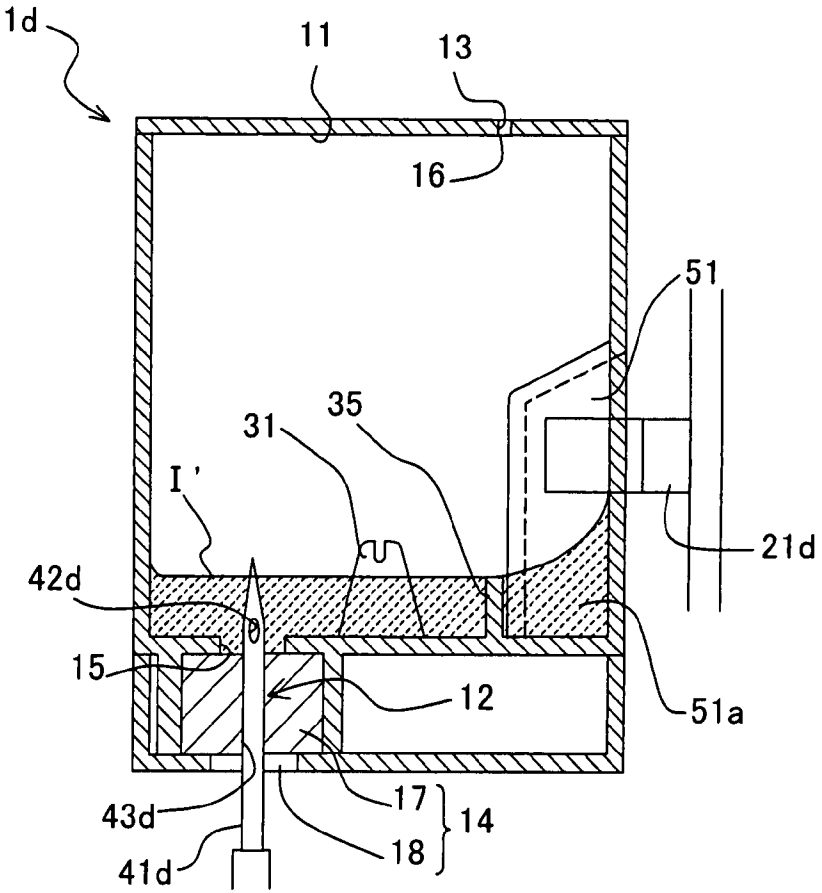
FIGS. 4A and 4B show sectional views taken along a line IV-IV shown in FIG. 1 illustrating the ink cartridge depicted in FIG. 1.
Figure 4A:
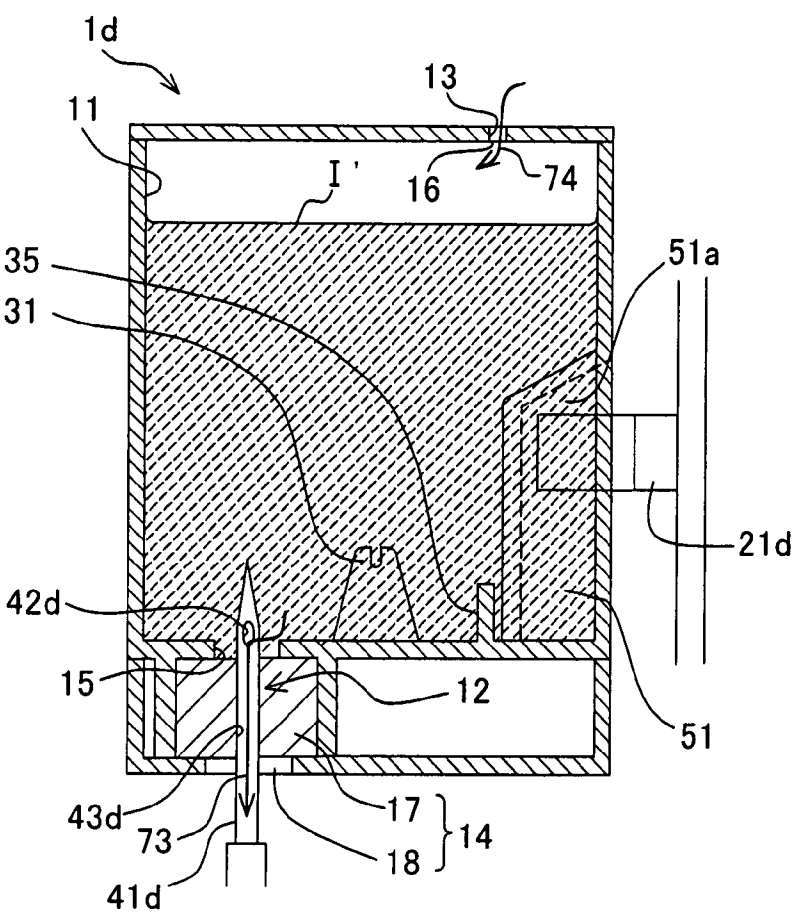

Next, an explanation will be made with reference to FIG. 4 about details of the ink cartridge 1*d* (second ink cartridge set) and the optical sensor 21*d*. FIG. 4 shows sectional views taken along a line IV-IV shown in FIG. 1 illustrating the ink cartridge 1*d*. FIG. 4A shows a sectional view illustrating a situation in which a sufficient amount of the ink is stored in the ink cartridge 1*d*. FIG. 4B shows a sectional view illustrating a situation in which any sufficient amount of the ink is not stored in the ink cartridge 1*d*, and the ink insufficiency is detected. In the drawing, an arrow 73 indicates the flow of the ink, and an arrow 74 indicates the flow of the atmospheric air.

The components or parts of the ink cartridge 1*d* are principally constructed of the same components or parts as those of the ink cartridge 1*a* except for the shutter mechanism 30 which have the same shapes and the same dimensions as those of the ink cartridge 1*a*. Therefore, the components or parts of the ink cartridge 1*d* will be described with the same reference numerals, any detailed explanation of which will be omitted.

As shown in FIG. 4A, the ink cartridge 1*d* is a substantially rectangular parallelepiped-shaped case formed of a light-transmissive synthetic resin. The ink cartridge 1*d* includes an ink tank which stores the nontransparent black pigment ink (I' in the drawing), an ink outflow passage 12 which allows the ink stored in the ink tank to flow to the outside of the ink cartridge 1*d*, an atmospheric air inflow passage 13 which allows the atmospheric air to flow into the ink tank 11, a joint 14 which connects the ink tank 11 and the ink supply pipe 41*d* and which holds the ink supply pipe 41*d* in the ink outflow passage 12, a support stand 31 and a regulating member 35. The ink supply pipe 41*d* is a tube or pipe having a tapered shape to be connected to the ink cartridge 1*d*. The ink supply pipe 41*d* is provided with a plurality of ink inflow ports 42*d* which are formed so that the ink inflow ports 42*d* are disposed in the circumferential direction of the sealed tip, and an intratubular ink flow passage 43*d* which is communicated with the outside via the ink inflow ports 42*d*.

The support stand 31 and the regulating member 35 are provided on the bottom of the ink tank 11. These components have the same shapes and the same dimensions as those of the support stand 31 and the regulating member 35 of the shutter mechanism 30 of the ink cartridge 1*a*, which are constructed in the same manner as those obtained by removing the lever 32, the float 33, and the shutter 34 from the shutter mechanism 30 of the ink cartridge 1*a*. That is, the ink tank of the ink cartridge 1*d* is constructed to have the same shape and the same dimension as those of the ink tank of each of the ink cartridges 1*a* to 1*c*. Therefore, the parts are commonly used for constructing the ink cartridges 1*a* to 1*d*.

As shown in FIGS. 4A and 4B, the ink liquid surface is raised in the vicinity of each of the wall surfaces of the ink tank due to the surface tension of the ink as compared with central portion of the ink tank 11. In particular, the projection 51 has the width of 3 mm which is narrow. Therefore, the ink liquid surface is further raised by the capillary phenomenon in the internal space 5*a*. Therefore, the optical sensor 21*d* is previously arranged at a position which is higher, by an amount of the increase in ink liquid surface, than the position at which the ink liquid surface can be detected at the central portion in the ink tank when the ink amount is a predetermined amount to be detected.

The optical sensor 21*d* is arranged so that the projection 51, which is formed on the side wall of the ink tank 11, is interposed between the light-emitting section and the light-receiving section from the outside of the ink tank 11 (see FIG. 3). The optical sensor 21*d* detects whether or not the light transmittance is blocked by the nontransparent ink stored in the ink tank 11. That is, the optical sensor 21*d* outputs, to the judging unit 62 of the control unit 22, the detection result of ON when the ink is present at the detecting position at which the optical sensor 21*d* is arranged in the vicinity of the center of the projection 51, or OFF when the ink is absent. When ON is inputted from the optical sensor 21*d*, the judging unit 62 judges that the ink cartridge 1*d* is installed to the holder 70*d*, and a sufficient amount of the ink is stored in the ink tank 11. On the other hand, when OFF is inputted from the optical sensor 21*d*, the judging unit 62 judges that the ink cartridge 1*d* is not installed to the holder 70*d*, or any sufficient amount of the ink is not stored in the ink tank 11.

In the preferred embodiment explained above, it is possible to correctly detect both of the ink amount detected by each of the optical sensors 21*a* to 21*c* for each of the ink cartridges 1*a* to 1*c* in which the light-transmissive dye inks are stored and the ink amount detected by the optical sensor 21*d* for the ink cartridge 1*d* in which the nontransparent pigment ink is stored. Therefore, the ink amount, which is to be detected upon the detection of the fact that the ink amount is not any sufficient amount, is successfully identical between the ink cartridges 1*a* to 1*c* in which the dye inks are stored and the ink cartridge 1*d* in which the pigment ink is stored. Accordingly, even when the dye inks and the pigment ink are used together in a mixed manner, it is possible to detect the correct ink amount for each of the ink cartridges 1*a* to 1*d* on the basis of the same logic.

The cheap light-transmissive type optical sensor 21*a* to 21*d*, in which the light-receiving section and the light-emitting section are disposed closely, can be used, because the width of the projection 51 is 3 mm. In other words, in order to use the cheap light-transmissive type optical sensor 21*a* to 21*d*, the light-transmissive area, which is detected by the optical sensor 21*a* to 21*d*, is formed at the narrow-width projection 51. As a result, the ink liquid surface in the projection 51 of the ink cartridge 1*d* is conspicuously raised as compared with the liquid surface at the central portion of the ink tank 11. However, according to this embodiment, the ink amount can be correctly detected even in the case of such a situation. Therefore, all of the inks can be detected sufficiently even with the cheap optical sensors 21*a* to 21*d*.

The projection 51 has the light-transmissive area in the direction of the change of the ink liquid surface in the ink tank 11. Therefore, it is possible to detect the amount of the stored ink by using the optical sensor 21*a* to 21*d*.

Additionally, it is possible to use the common parts, because all of the ink cartridges 1*a* to 1*d* have the same shape and the same dimension. Accordingly, it is possible to decrease the production cost for the ink cartridges 1*a* to 1*d*.

The ink cartridge 1*a* to 1*c* is provided with the shutter mechanism 30, and the orbit of the float 33 is fixed by the lever 32. Therefore, it is possible to avoid the adhesion of the float 33 to the side wall of the ink tank due to any disturbance such as the surface tension of the ink.

The shutter 34 is arranged at the detecting position only when the ink cartridge 1*a* to 1*c* is installed to the holder 70*a* to 70*c*, and the ink is sufficiently stored, and the shutter 34 is arranged at the non-detecting position in the case of situations other than the above. Therefore, the judging unit 62 can make the same judgment on the case in which the light-transmissive ink does not remain in the ink tank and the case in which the ink cartridge 1*a* to 1*c* stored with the light-transmissive ink is not installed to the holder 70*a* to 70*c*.

Additionally, the ink cartridge 1*a* to 1*d* is detachable with respect to the holder 70*a* to 70*d*. Therefore, it is possible to replenish the ink by the simple operation in which the ink cartridge 1*a* to 1*d* is exchanged.

The preferred embodiment of the present invention has been explained above. However, the present invention is not limited to the foregoing embodiment, which may be changed and designed in other various forms within the scope defined in claims. For example, the embodiment of the present invention is constructed such that the nontransparent ink is used for only the black. However, there is no limitation to the construction as described above. Any nontransparent ink of another color may be used provided that the light-transmissive ink and the nontransparent ink are used together in a mixed manner.

The embodiment of the present invention is constructed such that the projection 51 has the width of 3 mm. However, there is no limitation to the construction as described above. The projection 51 may have a width of not less than 3 mm, or the projection 51 may have a width of not more than 3 mm. In order to detect the ink amount highly accurately by using the cheap light-transmissive type optical sensor, it is preferable that the projection has a narrower width of not more than 3 mm.

Additionally, the embodiment of the present invention is constructed such that the entire ink cartridge 1*a* to 1*d* is the light-transmissive area, because the ink cartridge 1*a* to 1*d* is formed of the light-transmissive member. However, there is no limitation to the construction as described above. At least a part of the projection 51, which includes the detecting position, may be the light-transmissive area.

The embodiment of the present invention is constructed such that all of the portions of the ink cartridges 1*a* to 1*c*, 1*d* except for the shutter mechanism 30 have the same dimensions. However, there is no limitation to the construction as described above. The respective ink cartridges may have mutually different dimensions.

The embodiment of the present invention is constructed such that the lever 32, which includes the float 33 disposed at one end and the shutter 34 disposed at the other end, constitutes the shutter mechanism 30 which is supported swingably by the support stand 31. However, there is no limitation to the construction as described above. Another shutter mechanism may be provided, for example, such that the shutter mechanism is constructed by only a float formed with a shutter to be arranged at the projection 51.

Additionally, the embodiment of the present invention is constructed such that the ink cartridges 1*a* to 1*d* are detachably installed to the holders 70*a* to 70*d*. However, there is no limitation to the construction as described above. An ink cartridge may be fixed to a holder in an undetachable manner.

The embodiment of the present invention is constructed such that the judging unit 62 judges not only the ink amount in the ink tank of the ink cartridge 1*a* to 1*d* but also whether or not the ink cartridge 1*a* to 1*d* is installed to the holder 70*a* to 70*d*. However, there is no limitation to the construction as described above. The judging unit 62 may judge only the ink amount in the ink tank 11.

What is claimed is:

1. An ink cartridge set for an ink-jet recording apparatus, comprising:

a first ink cartridge which includes a first ink tank that contains a light-transmissive ink, and a nontransparent member arranged in the first ink tank so that the nontransparent member is movable depending on a residual amount of the ink, the first ink tank having a first light-transmissive area across which the nontransparent member passes; and a second ink cartridge which includes a second ink tank that contains a nontransparent ink, which is formed with a second light-transmissive area, and which includes no nontransparent member, wherein the first and second light-transmissive areas are provided at first and second projections which protrude from side surfaces of the first and second ink tanks respectively, and wherein the first and second projections have internal spaces thereof which are communicated with internal spaces of the first and second ink tanks respectively.

2. The ink cartridge set according to claim 1, wherein the light-transmissive ink is a dye ink, and the nontransparent ink is a pigment ink.

3. The ink cartridge set according to claim 1, wherein presence of the ink in the first ink tank is detected with blocking of light transmission by the nontransparent member, and presence of the ink in the second ink tank is detected with blocking of light transmission by the ink through the second light-transmissive area.

4. The ink cartridge set according to claim 1, wherein the width of the projection is not more than 3 mm.

5. The ink cartridge set according to claim 1, wherein both of the first and second projections are formed at least over areas of sizes which are obtained by combining sizes of the first and second light-transmissive areas in the direction of change of the liquid surface of the ink.

6. The ink cartridge set according to claim 1, wherein the first and second projections are formed to have an identical dimension.

7. The ink cartridge set according to claim 1, wherein the first and second ink cartridges have an identical dimension.

8. The ink cartridge set according to claim 1, wherein the first ink cartridge comprises a swinging member which is swingable with respect to a support point provided in the first ink tank, the swinging member includes the nontransparent member which is provided at one end and a float which is provided at the other end and which has a specific gravity smaller than that of the light-transmissive ink, and the nontransparent member is arranged in the internal space of the first projection.

9. An ink-jet recording apparatus comprising:

an ink-jet head which discharges inks;

first holder which holds a first ink cartridge which includes a first ink tank for storing a light-transmissive ink, and a nontransparent member arranged in the first ink tank so that the nontransparent member is movable depending on a residual amount of the ink, the first ink tank having a first light-transmissive area across which the nontransparent member passes;

a second holder which holds a second ink cartridge which includes a second ink tank for storing a nontransparent ink, the second ink tank being formed with a second light-transmissive area;

a first optical sensor which includes a first light-emitting section and a first light-receiving section arranged opposed to each other to interpose the first light-transmissive area of the first ink cartridge held by the first holder; and a second optical sensor which includes a second light-emitting section and a second light-receiving section arranged opposed to each other to interpose the second light-transmissive area of the second ink cartridge held by the second holder, the second light-emitting section and the second light-receiving section being arranged at positions higher than those of the first light-emitting section and the first light-receiving section of the first optical sensor in a direction of change of a liquid surface of the ink.

10. The ink-jet recording apparatus according to claim 9, wherein the first and second projections have widths which are smaller than widths of the side surfaces of the first and second ink tanks respectively.

11. The ink-jet recording apparatus according to claim 10, wherein the width of the projection is not more than 3 mm.

12. The ink-jet recording apparatus according to claim 10, wherein both of the first and second projections are formed at least over areas of sizes which are obtained by combining sizes of the first and second light-transmissive areas in the direction of change of the liquid surface of the ink.

13. The ink-jet recording apparatus according to claim 10, wherein the first and second projections are formed to have an identical dimension.

14. The ink-jet recording apparatus according to claim 10, wherein the first ink cartridge comprises a swinging member which is swingable with respect to a support point provided in the first ink tank, the swinging member includes the nontransparent member which is provided at one end and a float which is provided at the other end and which has a specific gravity smaller than that of the light-transmissive ink, and the nontransparent member is arranged in the internal space of the first projection.

15. The ink-jet recording apparatus according to claim 14, wherein:

a rotational force, which is received by the swinging member by buoyancies and gravities generated on the nontransparent member and the float respectively when the nontransparent member and the float are positioned in an ink liquid, is in a first direction that is opposite to a second direction of a rotational force received by the swinging member by buoyancies and gravities generated on the nontransparent member and the float respectively when at least parts of the nontransparent member and the float protrude from an ink liquid surface; and the nontransparent member is positioned in the first light-transmissive area when the swinging member receives the rotational force in the first direction, while the nontransparent member is positioned at a position deviated from the first light-transmissive area when the swinging member receives the rotational force in the second direction.

16. The ink-jet recording apparatus according to claim 9, wherein the first and second ink cartridges have an identical dimension.

17. The ink-jet recording apparatus according to claim 9, wherein the first and second ink cartridges are detachable with respect to the first and second holders respectively.

18. The ink-jet recording apparatus according to claim 17, further comprising a judging unit which judges states of residual amounts of the inks in the first and second ink cartridges depending on results of detection obtained by the first and second optical sensors, wherein:

the judging unit judges a state in which a sufficient amount of the ink is charged in the first ink cartridge installed to the first holder when the first optical sensor detects the nontransparent member, while the judging unit judges any one of a state in which the ink is decreased in the first ink cartridge installed to the first holder and a state in which the first ink cartridge is not installed to the first holder when the first optical sensor does not detect the nontransparent member; and the judging unit judges a state in which a sufficient amount of the ink is charged in the second ink cartridge installed to the second holder when the second optical sensor detects the ink adhered to an inner wall of the second projection, while the judging unit judges any one of a state in which the ink is decreased in the second ink cartridge installed to the second holder and a state in which the second ink cartridge is not installed to the second holder when the second optical sensor does not detect the ink adhered to the inner wall in the second projection.

19. The ink-jet recording apparatus according to claim 9, wherein the light-transmissive ink is a dye ink, and the non-transparent ink is a pigment ink.

* * * * *